United States Patent [19]

Titolo

[11] Patent Number: 4,773,359

[45] Date of Patent: Sep. 27, 1988

[54] VALVE CONTROL FOR OVERHEAD CAMSHAFT ENGINES

[75] Inventor: Andrea Titolo, Turin, Italy

[73] Assignee: Fiat Auto S.p.A., Turin, Italy

[21] Appl. No.: 104,907

[22] Filed: Oct. 6, 1987

[30] Foreign Application Priority Data

Oct. 7, 1986 [IT] Italy ..... 67759 A/86

[51] Int. Cl.[4] ..... F01L 1/26; F01L 1/20; F01L 1/08

[52] U.S. Cl. ..... 123/90.22; 123/90.17; 123/90.52

[58] Field of Search ..... 123/90.17, 90.22, 90.23, 123/90.33, 90.40, 90.44, 90.48, 90.49, 90.52

[56] References Cited

U.S. PATENT DOCUMENTS 1,836,111 12/1931 Fornaca ..... 123/90.22
4,517,936 5/1985 Burgio de Aragona .... 123/90.17 X
4,534,324 8/1985 Deuschmann et al. ..... 123/90.22
4,570,581 2/1986 Titolo ..... 123/90.17 X

FOREIGN PATENT DOCUMENTS 0684654 6/1930 France ..... 123/90.22
0132070 9/1919 United Kingdom ..... 123/90.22

*Primary Examiner*—Willis R. Wolfe
*Attorney, Agent, or Firm*—Sughrue, Mion, Zinn, Macpeak & Seas

[57] ABSTRACT

The subject of the invention consists of an overhead valve control for internal combustion engines provided with at least three valves per cylinder controlled through at least one overhead camshaft (1). The control is designed simultaneously to control two mated and parallel valves (3), and is so shaped as to be actuated by a variable profile cam (2).

2 Claims, 2 Drawing Sheets

VALVE CONTROL FOR OVERHEAD CAMSHAFT ENGINES

DESCRIPTION

The present invention is related to a device for the control of coupled valves in internal combustion engines fitted with at least two overhead variable profile camshafts and no less than three valves per cylinder.

The overhead valve controls which employ variable profile cams are used to change valve width and timing at will, in terms of rpm's with the aim of optimizing efficiency and fuel consumption.

Prior Japanese patent application No. 154928/86 to the same applicant, illustrated a device type including a swinging shoe, a shoe-holder saddle and a sliding cup in a seat obtained from the cylinder head.

The above patent application was however related to an internal combustion engine fitted with only two valves per cylinder.

The scope of the present invention is to accomplish a device of the above type, but suited for an engine fitted with three overhead valves at least.

Such and other scopes, are achieved through a device for the control of mated overhead valves in an internal combustion engine fitted with at least two overhead variable profile camshafts, of the type including a shoe in contact with the cam surface and a shoe-holder saddle, characterized by the fact that the shoe-holder saddle is, at its lower wall, provided with a guide cylindrical tang which fits in a seat obtained from the cylinder head and by the fact that the saddle also shows two prongs symmetrically placed sideways of it and suited to control the valve stems through the interposition of a clearance adjustment spacer.

Further characteristics and advantages will clearly appear from the next description relating to the attached schemes which are in no-way a restrictive example, and of which:

Figure 1:
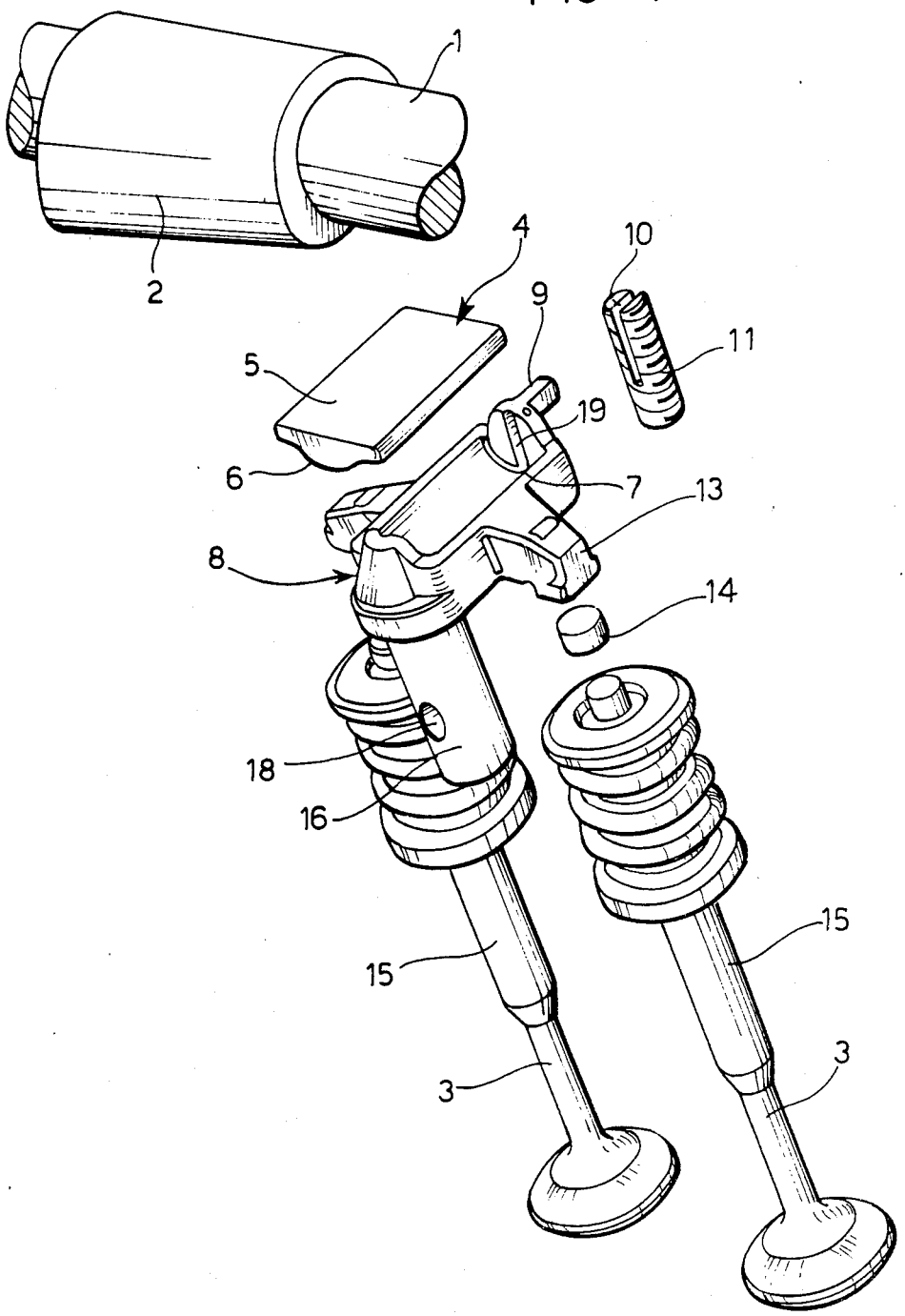
FIG. 1 is an exploded view of the invention device
Figure 2:
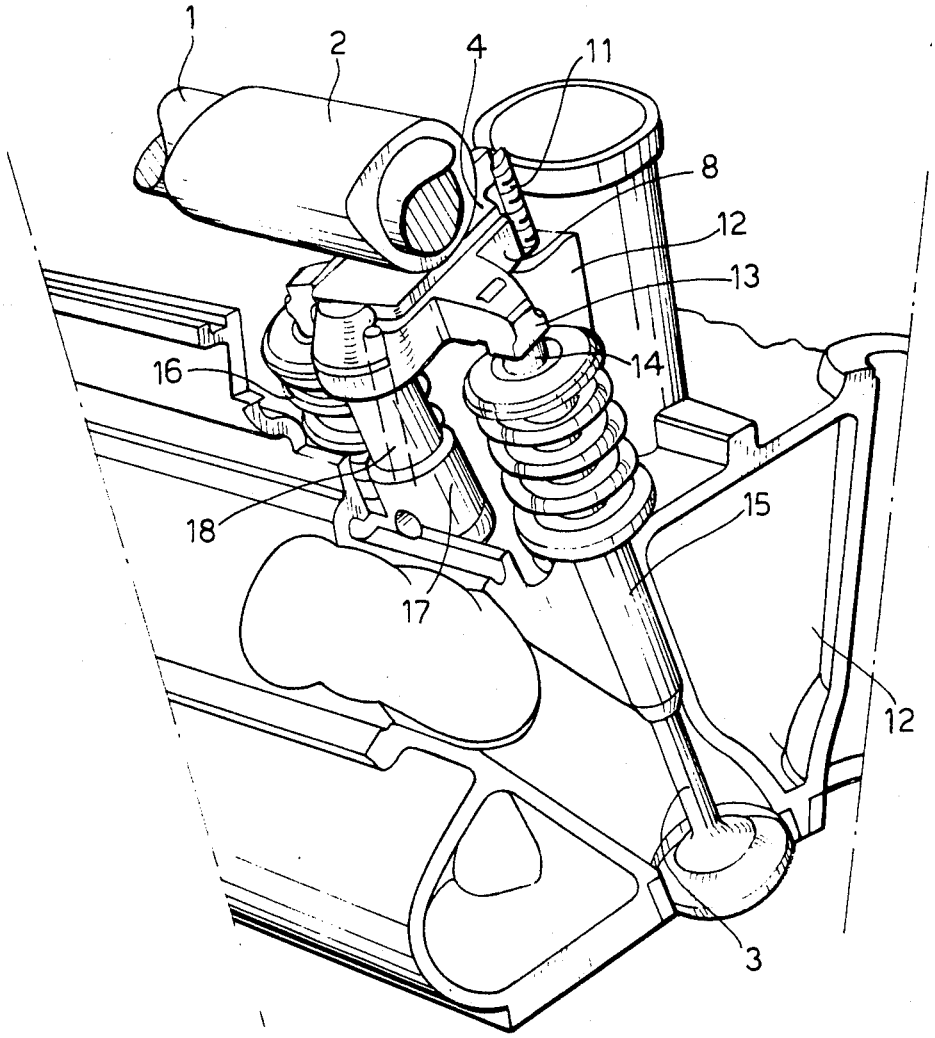
FIG. 2 is a view of the device as fitted to the cylinder head.

With reference to the figures, 1 shows a portion of a camshaft provided with a variable profile cam 2, fitted to an internal combustion engine in order to control the opening of the overhead valves 3.

The number 4 shows a rectangular shoe with upper flat surface 5 of shoe-cam contact and a lower surface showing a semi-circular projection 6 along the longitudinal axis of the shoe.

The above projection will match with a seat 7 having the same semi-circular section obtained from a shoe-holder saddle 8.

Such a fit allows the shoe to rotate around its longitudinal axis and then to follow, with its contact surface 5, the subsequent cam slope variations.

The shoe-holder saddle 8 is also provided with an extension 9 which is coaxial with its major axis, which fits in a sliding way in a cut 10 performed on a screw 11 screwed into the cylinder head 12 of the internal combustin engine, so as to avoid saddle rotation.

The length of the cut 10 shall be so calculated as not to prejudice the tappet stroke during valve opening.

The saddle 8 presents two prongs 13 placed sideways of it in a symmetrical position and suited to control, through the interposition of a clearance adjustment spacer 14, the valve stems 15 of the valves 3.

At its lower wall, the saddle 8 is provided with a cylindrical guide tang 16, suited to fit in a proper seat 17 obtained from the cylinder head 12.

The cylindrical tang is provided with a through hole 18 which, starting from the side wall, runs into seat 7 in a diffusion channel 19, obtained at the bottom of said seat and continuing along the bottom walls, so that oil may be flow up to the surface 5 of the shoe 4.

It is understood that the hole inlet 18 is in communication with the engine lubrication system.

I claim:

1. Internal combustion engine comprising at least one cylinder, a cylinder head, two overhead mated valves associated with the cylinder and having respective stems parallel to each other, an over-head camshaft having a variable-profile cam surface and follower means between said cam surface and the stems of said two mated valves comprising a swinging contact shoe in engagement with the cam surface and a shoe-holder saddle, wherein said shoe-holder saddle is provided with two symmetrically sideways displaced prongs adapted to operate said valve stems, clearance adjustment spacers being interposed between said prongs and said valve stems, and wherein the shoe-holder saddle is also provided with a cylindrical guide tang extending between said two prongs and fitting within a complementary seat disposed in the cylinder head, and wherein said cylindrical tang is provided with an axial through hole and with a radial inlet orifice communicating with one end of said axial hole and said shoe-holder saddle has a channel-shaped contact wall with the shoe communicating with the other end of the said axial hole of the tang.

2. Internal combustion engine according to claim 1, further comprising a lubrication system, wherein said inlet orifice is connected with said lubrication system.

* * * * *